US005960763A

United States Patent [19]

Yamamura

[11] Patent Number: 5,960,763

[45] Date of Patent: Oct. 5, 1999

[54] OIL PAN STRUCTURE FOR INTERNAL COMBUSTION ENGINE

[75] Inventor: Hideki Yamamura, Yokohama, Japan

[73] Assignee: Nissan Motor Co., Ltd., Kanagawa, Japan

[21] Appl. No.: 08/917,712

[22] Filed: Aug. 26, 1997

[30] Foreign Application Priority Data

Aug. 27, 1996 [JP] Japan ..... 8-224712

[51] Int. Cl.[6] ..... F02F 7/00

[52] U.S. Cl. ..... 123/195 C; 123/196 R; 184/6.5; 184/106

[58] Field of Search ..... 123/196 R, 195 A, 123/195 C; 184/6.5, 106

[56] References Cited

U.S. PATENT DOCUMENTS

| | | | |
|---|---|---|---|
| 1,713,872 | 5/1929 | Hunt | 184/6.5 |
| 4,911,118 | 3/1990 | Kageyama et al. | 123/195 H |
| 5,038,890 | 8/1991 | Tanaka et al. | 184/6.5 |
| 5,058,545 | 10/1991 | Hirai et al. | 123/195 C |
| 5,092,291 | 3/1992 | Langlois | 123/196 R |
| 5,103,782 | 4/1992 | Matsui | 123/195 C |
| 5,133,313 | 7/1992 | Inoue et al. | 123/195 C |
| 5,465,692 | 11/1995 | Uraki et al. | 123/195 C |
| 5,852,991 | 12/1998 | Yamamura et al. | 123/195 C |

FOREIGN PATENT DOCUMENTS

| | | | |
|---|---|---|---|
| 2751982 | 5/1979 | Germany | 123/195 C |
| 62-247158 | 10/1987 | Japan . | |
| 403 229957 | 10/1991 | Japan | 123/195 A |

*Primary Examiner*—Henry C. Yuen
*Assistant Examiner*—Hai Huynh
*Attorney, Agent, or Firm*—McDermott, Will & Emery

[57] ABSTRACT

An oil pan structure for an internal combustion engine includes an oil pan and a baffle plate extending over a bottom of the oil pan. The oil pan is formed with at least one flow regulating barrier projecting upwards from the bottom, and extending along a longitudinal direction of the engine to separate first and second longitudinal channels. The baffle plate is formed with at least one oil collecting hole in the form of a slit extending closely along an upper end of the flow regulating barrier, at a position just behind the upper end of the barrier with respect to a rotational direction of a crankshaft. The flow regulating barrier defines a constricted venturi throat between the lower surface of the baffle plate and the upper end of the barrier, to create a fluid pressure drop as a fluid flows through the venturi throat from the first channel to the second channel. The oil collecting hole opens into the second channel by the side of the upper end of the barrier to allow the lubricating oil on the baffle plate to be sucked into the second channel by the pressure drop.

20 Claims, 5 Drawing Sheets

OIL PAN STRUCTURE FOR INTERNAL COMBUSTION ENGINE

BACKGROUND OF THE INVENTION

The present invention relates to an oil pan structure for an internal combustion engine, and more specifically to an oil pan structure having a baffle plate.

In general, an oil pan structure has a deep oil storage section for storing a lubricating oil and a shallow oil collecting section for collecting the lubricating oil falling in the crankcase and directing the lubricating oil into the deep section. An oil pump driven by the crankshaft sucks the oil through an oil strainer from the deep section, and distributes the lubricating oil to various parts of the engine for lubrication.

The crankshaft and connecting rods rotate at high speeds closely over the oil pan. In order to prevent undesired collision between an engine rotating part and the lubrication oil, the shallow section of the oil pan is required to guide the lubricating oil promptly to the deep section. An oil pan structure disclosed in a Japanese Patent Provisional Publication No. 62(1987)-247158 has one or more rib-like flow regulating plates projecting upwards from the bottom of the shallow section and extending along a longitudinal direction of the engine to guide the lubricating oil smoothly into the deep oil storage section.

In some examples, a baffle plate of sheet metal extends over the shallow section to prevent the lubricating oil from swinging upward during a cornering operation of a vehicle and bumping against a rotating part. The baffle plate is formed with a plurality of oil collecting slit-shaped holes for allowing the lubricating oil to flow into a lower space in the shallow section under the baffle plate.

However, the oil collecting holes and the flow regulating plates are located separately, and the conventional oil pan structure is limited in rate of discharging the lubricating oil from the upper side of the baffle plate to the lower side. Specifically in a high engine speed range in which a large quantity of the oil is circulated, the limited drainage from the baffle plate tends to cause the oil to stay long on the baffle plate and to increase the possibility of collision between an engine rotating part and the oil on the baffle plate. The draining speed can be improved by increasing the opening size of the oil collecting holes. However, this tends to impair the ability to perform the required function of the baffle plate.

SUMMARY OF THE INVENTION

It is therefore an object of the present invention to provide an oil pan structure which can improve the oil collecting rate through holes of a baffle plate without increasing the hole size and thereby restrain collision between the lubricating oil and an engine rotating part.

According to the present invention, an oil pan structure for an internal combustion engine, comprises an oil pan and a baffle plate. The oil pan comprises at least one flow regulating barrier projecting upward from a bottom of the oil pan, and extending along a longitudinal direction of the engine. The baffle plate extends over the bottom of the oil pan, and comprises at least one oil collecting hole opening in the baffle plate at a position immediately behind the flow regulating barrier with respect to a rotational direction of a crankshaft of the engine. In this structure, the flow regulating barrier defines a constricted gap between a downwardly facing lower surface of the baffle plate and an upper end of the flow regulating barrier.

In the crankcase of the engine, the rotation of the crankshaft produces an air stream along the rotational direction around the crankshaft. This air stream pushes the lubricating oil in the oil pan in a lateral direction, and develops a tendency of the oil to flow in the lateral direction traversing the flow regulating barrier. Therefore, the fluid, oil and air, flows laterally through the constricted gap between the barrier and the baffle plate. As the fluid flows therethrough, the fluid increases its velocity, and the constricted gap lowers the pressure like a venturi tube, under the baffle plate around the oil collecting hole. The lowered pressure under the baffle plate draws the lubricating oil through the oil collecting hole from the upper side to the lower side of the baffle plate, and promotes the drainage of the oil from the upper side of the baffle plate.

The longitudinally extending flow regulating barrier dams the lateral oil flow on the upstream side of the barrier and tends to empty the corner just below the oil collecting hole on the downstream side of the barrier. This facilitates the discharge of the oil from the oil collecting hole into the corner on the downstream side.

DETAILED DESCRIPTION OF THE INVENTION

Figure 1:
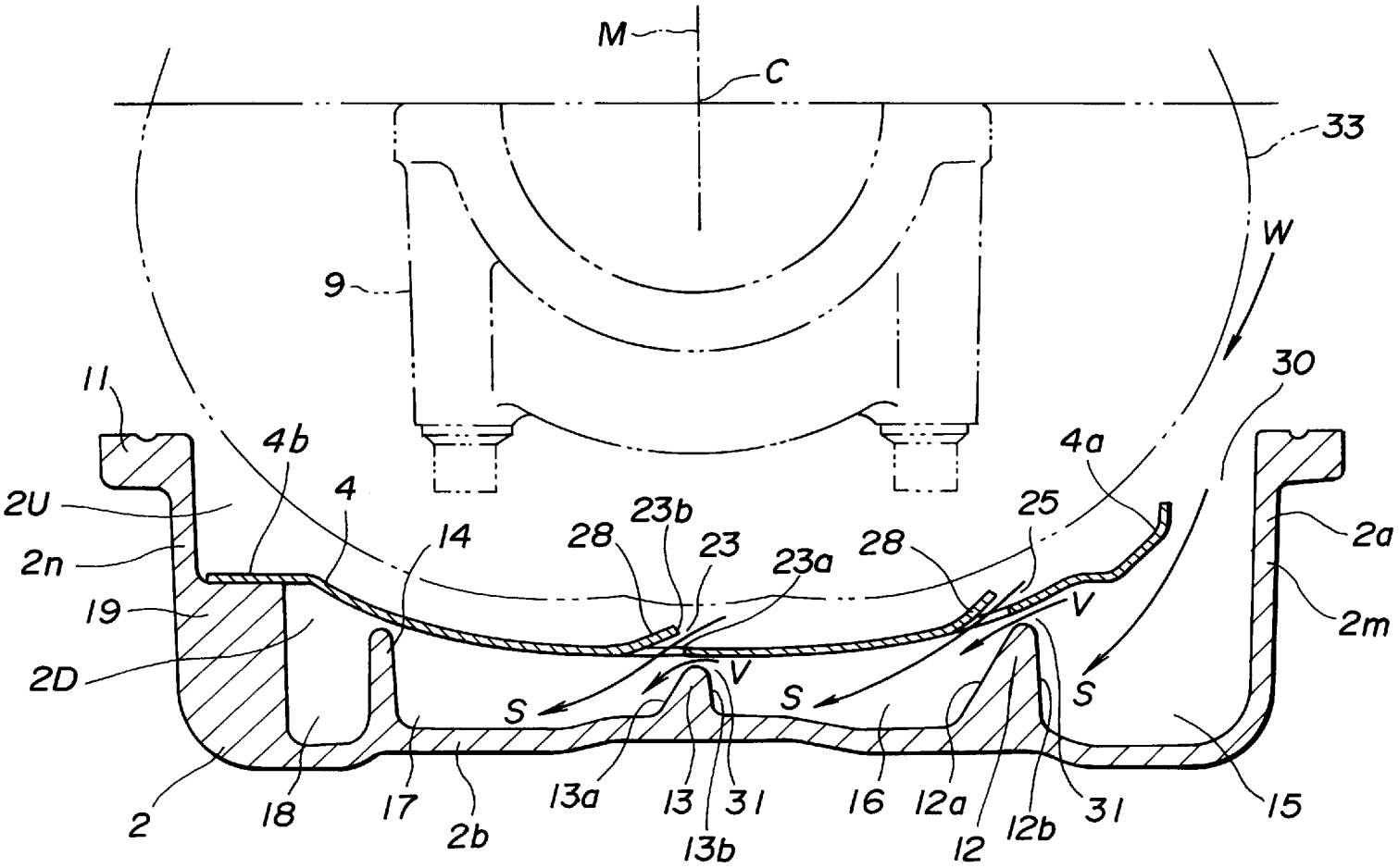
FIG. 1 is a sectional view of an oil pan structure according to one embodiment of the present invention, taken across a line I—I in FIG. 2.
Figure 2:
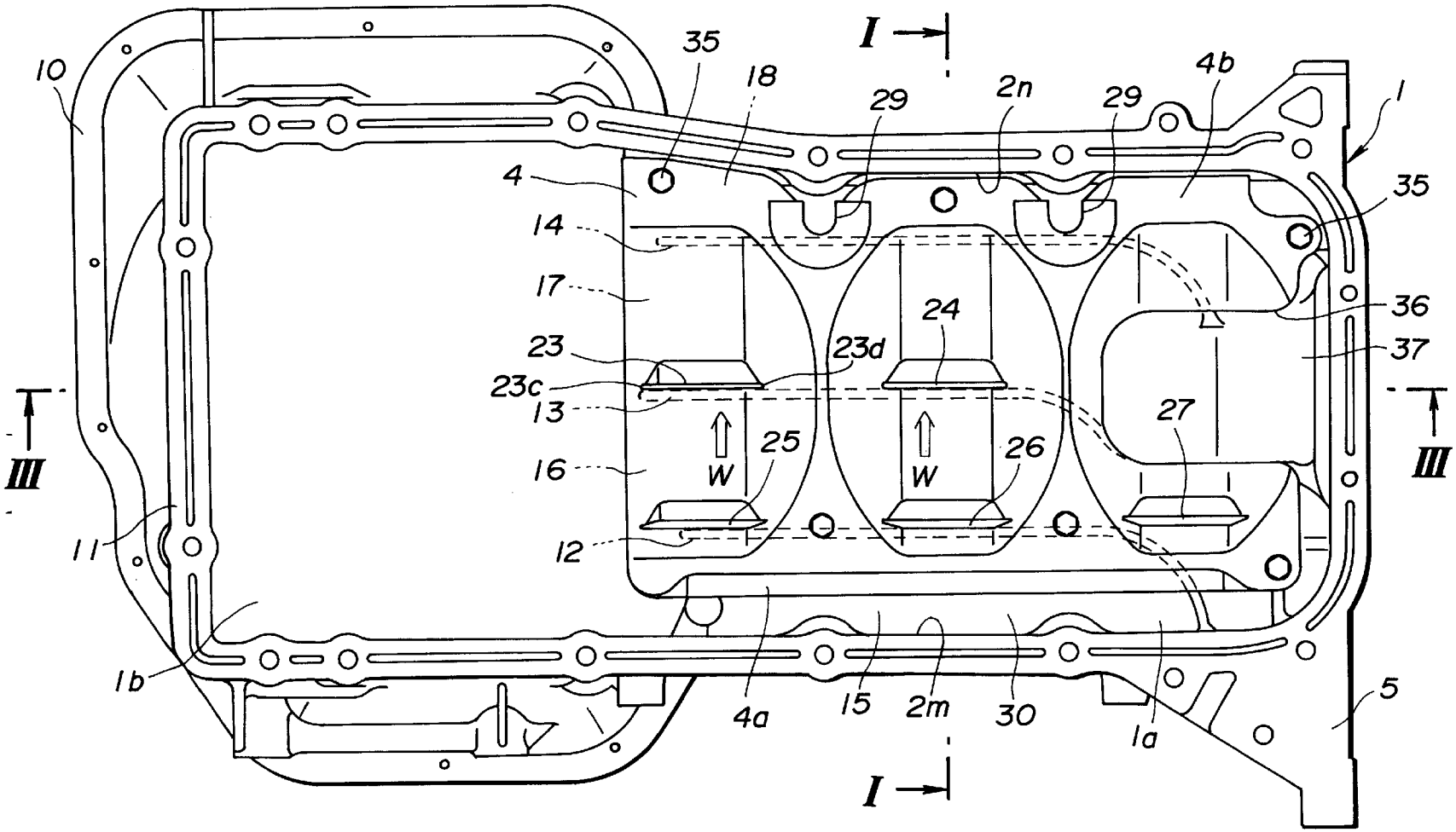
FIG. 2 is a plan view of the oil pan structure shown in FIG. 1.
Figure 3:
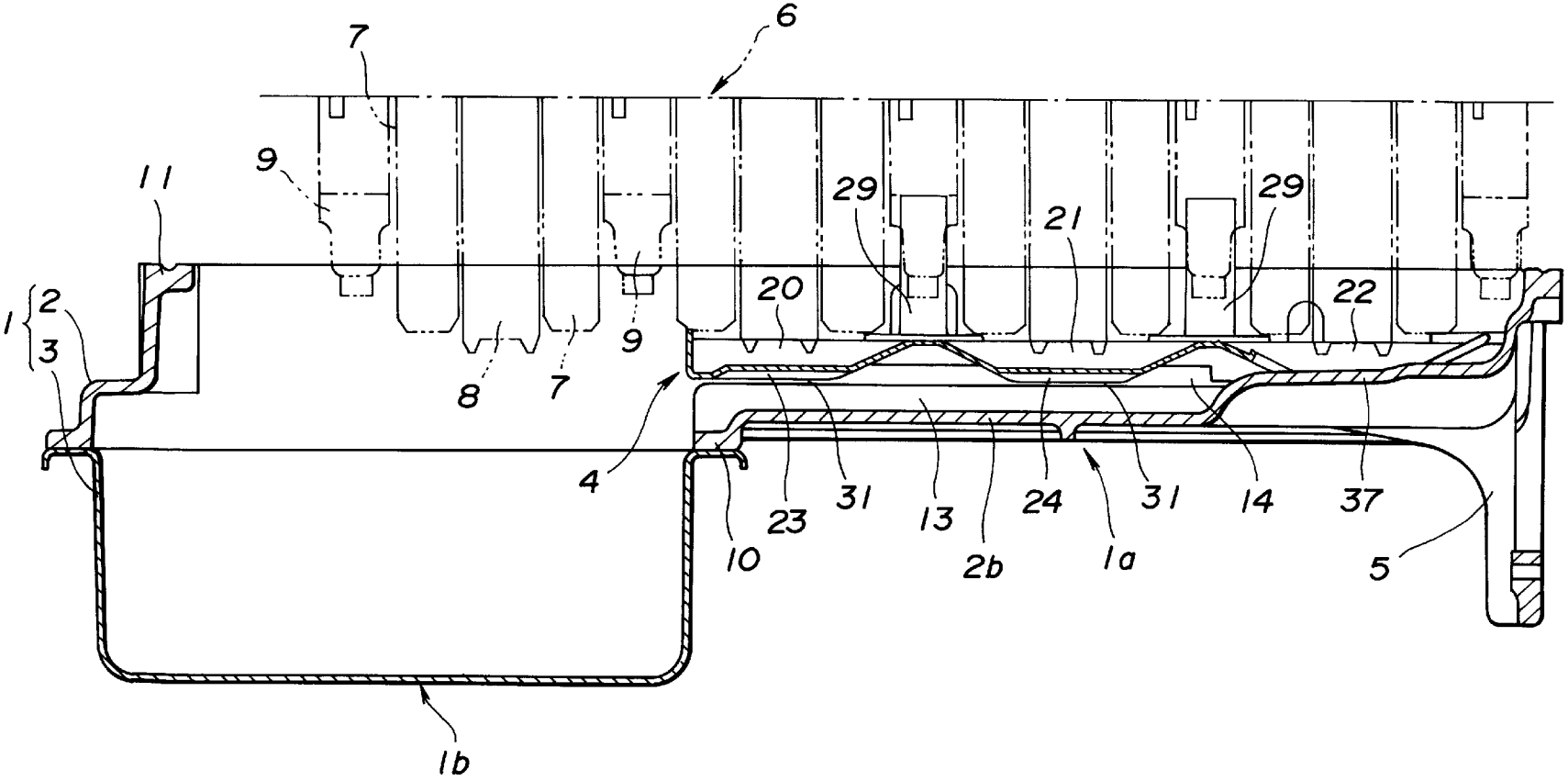
FIG. 3 is a sectional view, taken across a line III—III of FIG. 2.

FIGS. 1~3 show an oil pan structure according to a preferred embodiment of the present invention. This oil pan structure is designed for a four-cylinder in-line internal combustion engine.

An oil pan 1 is adapted to be fixed to an underside of an engine cylinder block, more specifically to a lower end of a skirt. The oil pan 1 of this example comprises an oil pan main member 2 and a tank member 3. The main member 2 of this example is made by aluminum die casting, and the tank member 3 is made by press forming of sheet metal. The main member 2 forms a shallow section 1*a*, and the tank member 3 forms a deep section 1*b* for storing a lubricating oil, as shown in FIG. 3.

The tank member 3 is located under the front part of the internal combustion engine, and fixed to the underside of the oil pan main member 2. The main member 2 has a lower flange 10 having a joint surface facing downwards. The tank member 3 is fixed to the lower flange 10 of the main member 2 by bolts (not shown). The main member 2 and the tank member 3 are thus assembled into a unit.

The main member 2 has a front part located on the tank member 3 under the front part of the engine, and a rear part located under the rear part of the engine. The front part of the main member 2 is bottomless and opens into the tank member 3 to form the deep section 1*b* with the tank member 3. The shallow section 1*a* is formed by the rear part of the main member 2. The rear part of the main member 2 has a bottom 2*b* for collecting the lubricating oil, and serving as a bottom of the shallow section 1*a*.

The oil pan main member 2 further has first and second upright side walls 2*m* and 2*n*, as shown in FIG. 1. An oil collecting space is defined on the bottom 2*b* between the first and second side walls 2*m* and 2*n*.

A baffle plate 4 extends over the bottom 2*b* of the shallow section 1*a*, and divides the coil collecting space into an upper subspace (or chamber) 2U over the baffle plate 4 and a lower subspace (or chamber) 2D between the bottom 2*b* and the baffle plate 4.

The oil pan main member 2 has a rear end formed with a transmission mounting portion 5 to which a transmission (not shown) is connected.

A crankshaft 6 of the engine is located just above the oil pan main member 2. As shown in FIG. 3, the bottom 2*b* of the oil pan shallow section 1*a* is close to counterweights 7 of the crank shaft 6 and connecting rods 8. The baffle plate 4 extends between the bottom 2*b* and these rotating parts of the engine. The crankshaft 6 is supported by bearing caps 9 shown in FIGS. 1 and 3. The oil pan main member 2 is further formed with an upper flange 11 joined to a lower flange surface of the cylinder block (not shown).

The first and second side walls 2*m* and 2*n* of the oil pan member 2 extend in a longitudinal direction of the engine along an axis C of the crankshaft 6. In the view of FIG. 1, the crankshaft rotation is in a clockwise direction as shown by an arrow W, the first side wall 2*m* is on the right side and the second side wall 2*n* is on the left.

The bottom 2*b* of the oil pan shallow section 1*a* is formed with three flow regulating barriers (or flow regulating plates) 12, 13 and 14 extending in the longitudinal direction of the engine. In this example, the barriers 12, 13 and 14 are jointless integral parts of the oil pan main member 2. The flow regulating barriers 12, 13 and 14 project upwards from the bottom 2*b* like ribs, and extend through almost the full extent of the bottom 2*b* from the front end to the rear end of the bottom 2*b*. The flow regulating barriers 12, 13 and 14 divide the lower subspace 2D between the bottom 2*b* and the baffle plate 4 into four channels 15, 16, 17 and 18 extending in the longitudinal direction of the engine.

The rear end segment of each flow regulating barrier is curved toward the first side wall 2*m*, as shown in FIG. 2. In the view of FIG. 2, the rotating parts such as the counterweights 7 move in the lateral direction shown by arrows W from the first side wall 2*m* toward the second side wall 2*n*. Therefore, the rear end of each of the channels 15, 16, 17 and 18 is curved toward the first side wall 2*m*, and opens upstream toward the first side wall 2*m*.

The second flow regulating barrier 13 is located directly below the axis C of the crankshaft 6. An imaginary vertical middle (or median) plane M containing the crankshaft axis C passes through the second barrier 13. The first and third barriers 12 and 14 are arranged approximately in a manner of bilateral symmetry with respect to the vertical middle plane M. The first side wall 2*m* of the oil pan main member 2 is located on a first lateral side of the imaginary vertical middle plane M whereas the second side wall 2*n* is on a second lateral side opposite to the first lateral side. As viewed in FIG. 1 in which the engine rotation is clockwise as shown by the arrow W, the first lateral side is the right side of the middle plane M, and the second lateral side is the left side. The engine rotation about the crankshaft axis C is in the form of a downward angular motion on the first lateral side, and an upward angular motion on the second lateral side. The oil pan structure of this example is approximately symmetrical with respect to the middle (or median) plane M, but the bilateral symmetry of the oil pan structure is not perfect. The middle (or median) plane M divides the oil pan structure into the left and right similar halves, but each of the right and left halves is not an exact mirror image of the other.

Each of the first and second barriers 12 and 13 has a sloping side surface 12*a* or 13*a* facing toward the second side wall 2*n*, and an opposite steeper side surface 12*b* or 13*b* facing toward the first side wall 2*m*, as shown in FIG. 1. The steeper side surface 12*b* or 13*b* of each of the first and second barriers 12 and 13 is steeper than the sloping side surface 12*a* or 13*a*.

The oil pan main member 2 is formed with a plurality of bosses 19 which are smaller in height than the upper flange 11. Each boss 19 has an upwardly facing top surface. The baffle plate 4 is fixed to the top surfaces of the bosses 19 by bolts 35 as shown in FIG. 2.

Figure 4:
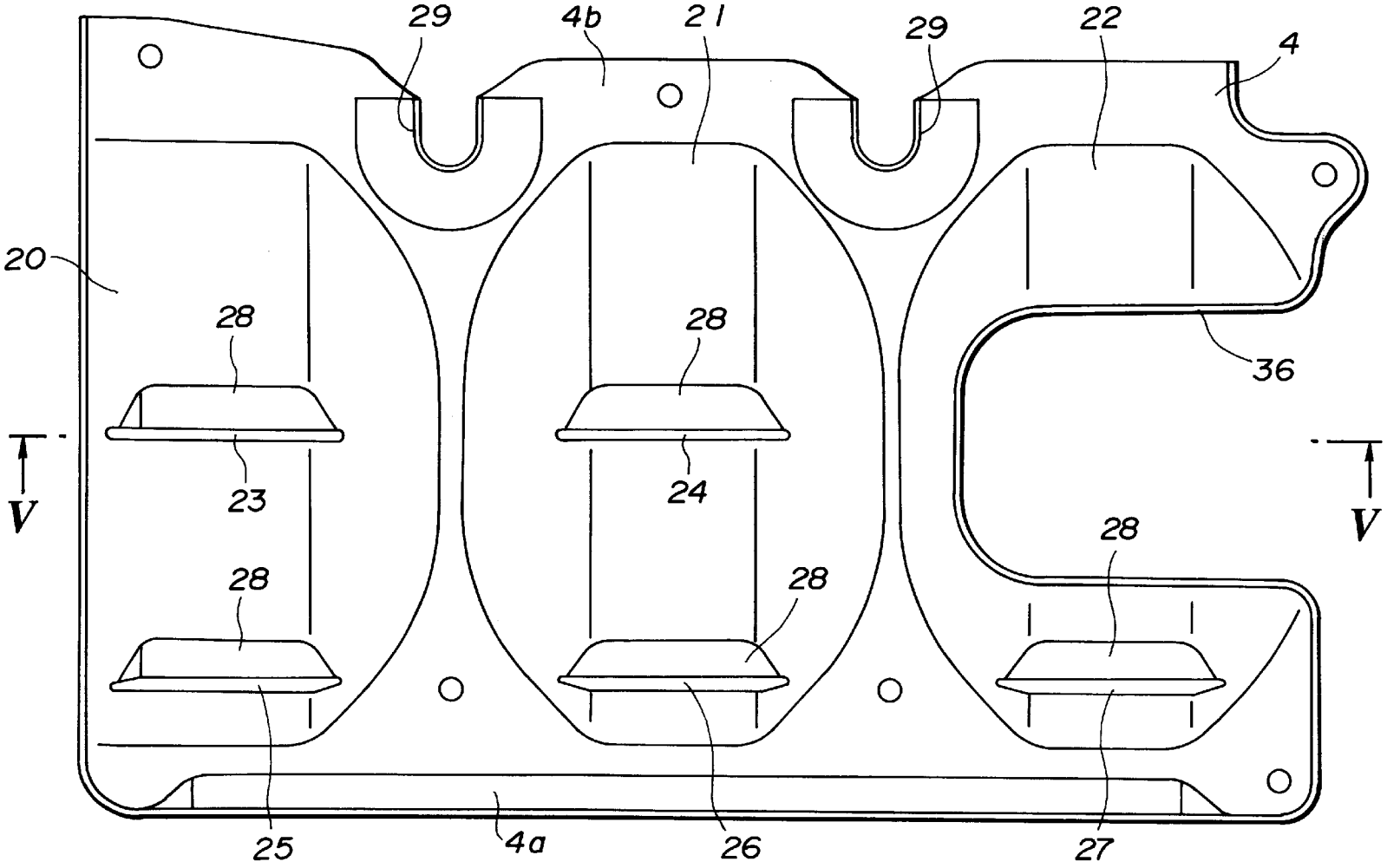
FIG. 4 is a plan view of a baffle plate of the oil pan structure shown in FIGS. 1~3.
Figure 5:
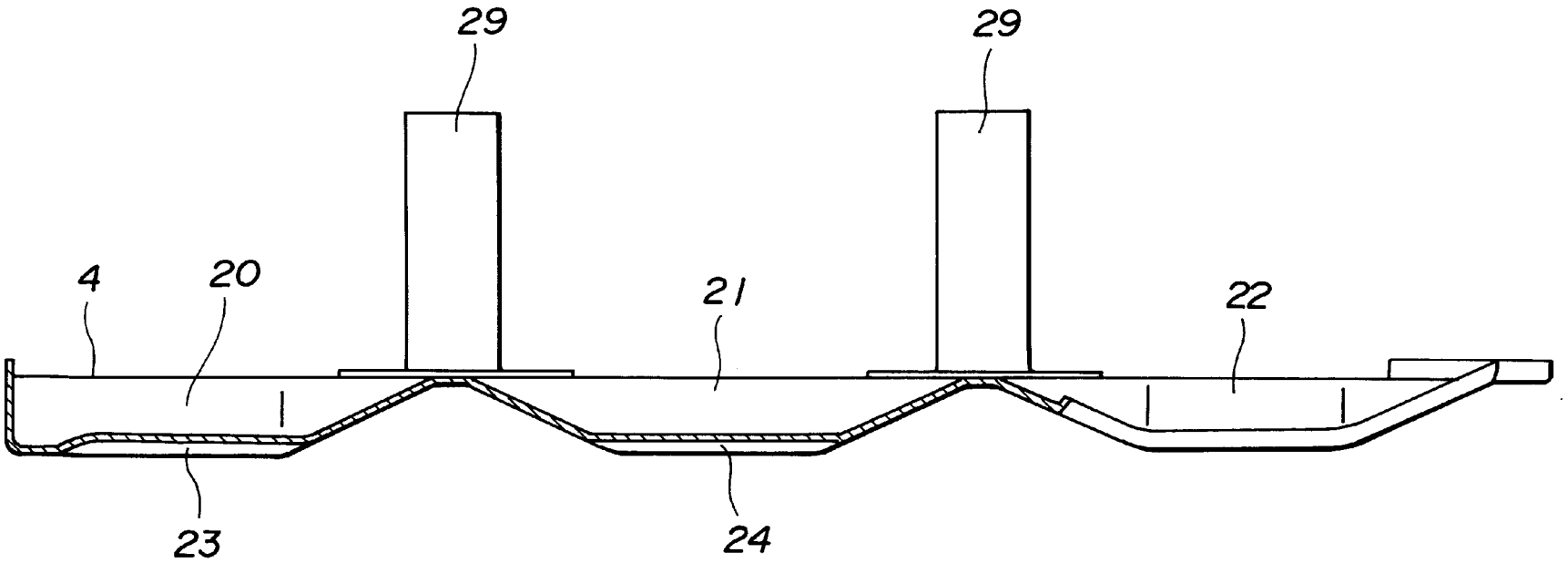
FIG. 5 is a sectional view of the baffle plate taken across a line V—V of FIG. 4.

FIGS. 4 and 5 shows the baffle plate 4 alone. The baffle plate 4 of this example is formed by press forming of relatively thin metal sheet (or plate). As shown in FIGS. 4 and 5, the baffle plate 4 is formed with three depressions 20, 21 and 22 arranged in the longitudinal direction of the engine. These depressions 20, 21, 22 are designed to prevent interference of the baffle plate 4 with the counterweights 7 and the connecting rods 8 and collision of the rotating parts against the oil. The depressions 20, 21 and 22 correspond to the second (#2) cylinder, the third (#3) cylinder and the fourth (#4) cylinder, respectively, as shown in FIG. 3. The first (#1) cylinder is located just above the rear half of the deep section 1*b*. Each of the depressions 20, 21 and 22 is concave in conformity with a trajectory 33 of the adjacent rotating part such as the connecting rod 8, and deepest at a middle portion just below the axis C of the crankshaft 6. Each depression is depressed like a concave ellipsoidal surface.

The oil pan main member 2 has a rear middle bulge 37 bulging upwards at the rear middle of the shallow section 1*a* to receive a part of the transmission. The baffle plate 4 is formed with a rectangular (or U-shaped) indentation 36 indented from the middle of the rear end toward the front end of the baffle plate 4, so as to receive the rear bulge 37 of the oil pan main member 2. The indentation 36 extends into the rearmost third depression 22 as shown in FIG. 4.

Oil collecting holes 23~27 are formed in the baffle plate 4. In this example, there are five of the oil collecting holes 23~27. Each hole is in the form of a slit extending along the longitudinal direction of the engine. In this example, there are two rows of the slits. The rows extend in parallel to each other along the longitudinal direction of the engine, and the two rows are separated along the lateral direction perpendicular to the longitudinal direction of the engine. The first and second oil collecting slits 23 and 24 are arranged in a straight row along the longitudinal direction of the engine just below the axis of the crankshaft 6. The third, fourth and fifth oil collecting slits 25, 26 and 27 are arranged in a straight row along the longitudinal direction near a first lateral side margin 4*a* of the baffle plate 4. The first and third slits 23 and 25 are arranged in the front depression 20 along the lateral direction. The first slit 23 is located at the deepest middle portion of the front depression 20. Similarly, the second and fourth slits 24 and 26 are arranged in the center depression 21 along the lateral direction, and the second slit 24 is at the deepest middle portion of the center depression 21. The fifth slit 27 is formed in the rear depression 22 on the first lateral side of the indentation 36.

Each of the oil collecting slits 23~27 is formed by first cutting a straight slit in the base metal of the baffle plate 4, and slightly raising one side of the slit to form a hood-like raised covering portion 28. The covering portion 28 slopes down in the lateral direction toward the second side wall 2*n*. Each oil collecting slit opens in an oblique direction halfway between the upward direction and the lateral direction toward the first side wall 2*m*. The covering portion 28 of each slit is located on the second lateral side of the slit (that is, on the left side of the slit in FIG. 1). The first oil collecting slit 23, for example, is defined between first and second cut edges 23*a* and 23*b*, as shown in FIG. 1, and the first and second cut edges 23*a* and 23*b* extend from a front slit end 23*c* to a rear slit end 23*d* along the longitudinal direction of the engine, as shown in FIG. 2. The first edge 23*a* is slightly closer to the first side wall 2*m* than the second edge 23*b*, and faces toward the second side wall 2*n*. The second edge 23*b* is slightly closer to the second side wall 2*n* and faces toward the first side wall 2*m*. The second edge 23*b* is located on the second lateral side of the first edge 23*a*, and located above the first edge 23*a*. The other oil collecting holes 24, 25, 26 and 27 are formed in the same manner.

The baffle plate 4 extends laterally from the first lateral side margin 4*a* located near the first side wall 2*m* to a second lateral side margin 4*b* fixed to the second side wall 2*n*. The first and second side margins 4*a* and 4*b* extend along the longitudinal direction of the engine on the first and second lateral sides of the middle plane M. The depressions 20, 21, and 22 are formed between the first and second margins 4*a* and 4*b*.

Two oil guides 29 are fixed to the second lateral margin 4*b* of the baffle plate 4. Each oil guide 29 projects upwards, and is shaped like a semicylinder. In the assembled state, the upper end of each oil guide 29 confronts an open lower end of an oil hole formed in the cylinder block. The oil guides 29 receive the lubricating oil flowing downwards from the cylinder block through the oil holes of the cylinder block, and guide the lubricating oil into the lower subspace 2D under the baffle plate 4.

The oil guides 29 are located on the second lateral side of the middle plane M, or on the downstream side with respect to the rotational direction W from the first side wall 2*m* toward the second side wall 2*n*. On the other hand, the row of the third, fourth and fifth oil collecting slits 25, 26 and 27 is located on the first lateral side or the upstream side of the middle plane M.

An air inlet opening 30 is formed between the first side wall 2*m* and the first lateral margin 4*a* of the baffle plate 4. The air inlet opening 20 is relatively large in size, and extends over the entire length of the baffle plate 4. The air inlet opening 30 opens upwards. The air inlet opening 30 is designed to receive a downward air stream flowing from above along the inside surface of the first side wall 2*m* driven by the rotation of the crankshaft 6 in the rotational direction W, and to guide the downward air stream into the lower subspace 2D under the baffle plate 4, specifically into the first channel 15 between the flow regulating barrier 12 and the first side wall 2*m*. The crankshaft rotation produces the downward air stream on the first lateral side of the crankshaft axis C (that is, the right side as viewed in FIG. 1), and the air flows downwards along the inside surface of the crankcase, and further flows smoothly along the inside surface of the first side wall 2*m* of the oil pan main member 2, into the lower subspace 2D under the baffle plate 4. The inside surface of the first side wall 2*m* of this example is smooth and designed to guide the downward air stream smoothly into the lower subspace 2D.

In the assembled state in which the baffle plate 4 is fixed to the oil pan main member 2, the first (front middle) oil collecting hole 23 and the second (center middle) oil collecting hole 24 are adjacent to the middle flow regulating barrier 13. The first and second middle oil collecting holes 23 and 24 open at a position immediately behind the middle barrier 13 (on the downstream side of the middle barrier 13 with respect to a lateral fluid stream in the lateral direction from the first side wall 2*m* toward the second side wall 2*n*). The upper end of the middle barrier 23 extends closely along the first edge 23*a* of the first oil collecting hole 23 and along the first edge of the second oil collecting hole 24. In the example shown in FIG. 1, the first edge 23*a* of the first oil collecting hole 23 is located just above the second-side sloping side surface 13*a* of the middle barrier 13. Similarly, the first edge of the second oil collecting hole 24 is just above the sloping side surface 13*a*. The first and second middle oil collecting holes 23 and 24 open into the third channel 17 at the side of the middle barrier 13.

Similarly, the third (front first side) oil collecting hole 25, the fourth (center first side) hole 26 and the fifth (rear first side) hole 27 are adjacent to the first side flow regulating barrier 12. The first side oil collecting holes 25, 26 and 27 open at a position immediately behind the first side barrier 12. In the example shown in FIG. 1, the first edge of each of the first side oil collecting holes 25, 26 and 27 is located just above the second-side sloping side surface 12*a* of the first side barrier 12. Each of the front, center and rear first side oil collecting holes 25, 26 and 27 opens into the second channel 16 at the side of the first side barrier 12.

Constricted gaps 31 are formed between the downwardly facing lower surface of the baffle plate 4 and the upper ends of the first side and middle flow regulating barriers 12 and 13. In each gap 31, the separation between the upper end of the barrier 12 or 13 and the lower surface of the baffle plate 4 is made so small as to produce the effect of a venturi tube effectively. For example, the separation is about 2 mm. As shown in FIG. 3, the height of each of the flow regulating barriers 12 and 13 is uniform along the longitudinal direction of the engine. The upper end of each of the barriers 12 and 13 extends straight along the crankshaft axis C.

The thus-constructed oil pan structure collects and stores the lubricating oil in the following manner.

On the second lateral (downstream) side, the lubricating oil discharged from the oil holes of the cylinder block flows downwards through the oil guides 29 of the oil pan structure. Each oil guide 29 protects the downward oil stream on the second lateral side and guides the downward oil stream into the lower subspace 2D under the baffle plate 4. The fourth longitudinal channel 18 between the second side wall 2*n* and the third barrier 14 receives most of the lubricating oil from the oil guides 29, and leads the oil longitudinally into the oil storage deep section 1*b*.

On the first lateral (upstream) side, the lubricating oil flows downwards on the inside wall surface of the crankcase, and enters the first longitudinal channel 15 through the inlet opening 30 between the baffle plate 4 and the first side wall 2*m*. The first channel 15 leads the lubricating oil longitudinally into the deep section 1*b*.

The baffle plate 4 catches the lubricating oil dropping from above. The oil on the baffle plate 4 is introduced through the oil collecting holes 23~27 into the second and third longitudinal channels 16 and 17 under the baffle plate 4. These channels 16 and 17 conduct the oil longitudinally into the deep section 1*b*.

In the crankcase, the crankshaft 6 rotates at high speeds in the direction W shown in FIG. 1, and this rotation produces an air stream along this rotational direction W in the crankcase. This air stream pushes the lubricating oil, and there is formed, in the oil pan 1, a fluid stream entering the channels 15~17, as shown by arrows S. The velocity vector of this fluid stream has a component of a considerable magnitude in the lateral direction from the first side wall 2*m* toward the second side wall 2*n* as shown by the arrows S. On the baffle plate 4, the oil collecting holes 23~27 opening upstream toward the first side wall 2*m* can catch the lubricating oil effectively and the lubricating oil is forced into the oil collecting holes 23~27.

In the lower subspace 2D under the baffle plate 4, the fluid, the oil and/or air, flows laterally from the first channel 15 to the second channel 16 through the constricted gaps 31 formed by the barrier 12, and then further flows from the second channel 16 to the third channel 17 through the constricted gaps 31 formed by the middle barrier 13, as shown by arrows V in FIG. 1. Each of the constricted gaps 31 serves as a constricted throat of a venturi tube between tapered sections, and cause a drop in fluid pressure as the fluid flows through the gap 31. When the fluid flows fast through the gap 31, the pressure around the adjacent oil collecting hole under the baffle plate 4 is lowered, and the lowered pressure draws the lubricating oil through the oil collecting hole from the upper subspace 2U over the baffle plate 4 to the lower subspace 2D under the baffle plate 4.

The air stream forces the oil into each oil collecting hole from above on the upper side of the baffle plate 4. On the lower side of the baffle plate 4, the partial vacuum formed by a lateral draft through the venturi constriction of the adjacent gap 31 draws the oil from below. The oil pan structure of this design can collect the lubricating oil through the collecting holes 23~27 into the channels 16 and 17 rapidly. The second-side sloping surface 12*a* or 13*a* of each of the barriers 12 and 13 forms a smooth outlet taper for guiding the fluid stream discharged from the adjacent gap 31. The inlet opening 30 opening upwards catches the downward air stream along the first side surface 2*m* effectively, and leads the air stream into the lower subspace 2D under the baffle plate 4. The inlet opening 30 acts to increase the flow rate of the lateral air stream under the baffle plate 4 from the first side wall 2*m* toward the second side wall 2*n*, and secure the effect of a venturi tube.

In each of the longitudinal channels 15, 16 and 17, the lubricating oil is pushed to the second lateral side or to the downstream side by the lateral air stream from the first side wall 2*m* toward the second side wall 2*n*. In the first channel 15, for example, the lubricating oil is pushed toward the barrier 12, and collected along the barrier 12. Similarly, the oil tends to gather along the barrier 13 in the second channel 16, and along the barrier 14 in the third channel 17. In each channel, the oil is pushed aside from the upstream region directly under the oil collecting holes, and therefore the oil can readily enter the channel through the oil collecting holes from the upper subspace 2U, without being disturbed by the oil flow directly under the oil collecting holes. Furthermore, the longitudinal channels 15, 16 and 17 are independent from each other, so that the oil stream in each channel is not disturbed by the oil in a neighboring channel. Thus, the oil can flow smoothly as shown by the arrows S in FIG. 1 through the oil collecting holes 23~27 into the channels 16 and 17 without interference with the oil flows in the channels 16 and 17.

The oil pan structure improves the oil collecting rate through the oil collecting holes 23~27, and discharge the oil falling on the baffle plate 4 smoothly and quickly into the lower subspace 2D under the baffle plate 4. The first and second middle oil collecting holes 23 and 24 are opened at the central deepest points of the ellipsoidal depressions 20 and 21, respectively. Therefore, the depressions 20 and 21 collects the oil widely, and the middle oil collecting holes 23 and 24 drain the oil from the depressions 20 and 21 in a reliable and speedy manner. This baffle plate design prevents the lubricating oil from lingering on the baffle plate 4, and reduces the possibility of collision of the rotating parts such as the counterweights 7 against the oil. Therefore, this design can prevent undesired effects of air mingled and entrapped in the lubricating oil by the rotating parts beating against the oil, and the occurrence of mechanical loss.

In this example, no oil collecting holes are formed in the vicinity of the third barrier 14, and the baffle plate covers the fourth channel 18. The first side margin 4*a* of the baffle plate 4 juts upward and rightward in FIG. 1 toward the first lateral side wall 2*m* over the first channel 15.

What is claimed is:

1. An oil pan structure for an internal combustion engine, comprising:

an oil pan comprising a flow regulating barrier projecting upward from a bottom of the oil pan, and extending along a longitudinal direction of the engine; and a baffle plate extending over the bottom of the oil pan, and comprising an oil collecting hole opening in the baffle plate at a position immediately behind the flow regulating barrier with respect to a rotational direction of a crankshaft of the engine;

wherein the flow regulating barrier defines a constricted gap between a downwardly facing lower surface of the baffle plate and an upper end of the flow regulating barrier.

2. An oil pan structure according to claim 1 wherein the oil pan further comprises first and second upright side walls extending along the longitudinal direction of the engine on both sides of the baffle plate, the first side wall defines an inlet opening for receiving a downward air stream, and introducing the air stream into a lower space between the bottom of the oil pan and the baffle plate, the inlet opening opens upwards between the first side wall and the baffle plate, the oil regulating barrier comprises a first side surface facing toward the first side wall of the oil pan and bounding a first longitudinal channel extending along the longitudinal direction of the engine, and a second side surface facing toward the second side wall and bounding a second longitudinal channel extending along the longitudinal direction of the engine, and the oil collecting hole comprises an upper end opening toward the first side wall on an upper side of the baffle plate, and a lower end opening into the second longitudinal channel near the flow regulating barrier on a lower side of the baffle plate.

3. An oil pan structure for an internal combustion engine, comprising:

an oil pan comprising a deep section for storing a lubricating oil and a shallow section for directing the lubricating oil along a longitudinal direction of the engine into the deep section, the shallow section comprising a plurality of flow regulating barriers projecting upward from a bottom of the shallow section, and extending in the longitudinal direction of the engine; and a baffle plate extending over the bottom of the shallow section of the oil pan, the baffle plate being formed with an oil collecting slit extending alongside an upper end of an adjacent barrier in the longitudinal direction of the engine, the adjacent barrier being one of the flow regulating barriers, wherein the upper end of the adjacent barrier is proximate to a downwardly facing lower surface of the baffle plate, and forms a constricted gap between the lower surface of the baffle plate and the upper end of the adjacent barrier, and the oil collecting slit is located just behind the adjacent barrier with respect to a rotational direction of a crankshaft of the engine.

4. An oil pan structure according to claim 3 wherein the oil pan further comprises first and second upright side walls between which the shallow section is defined, the first side wall is located on a first lateral side of a crankshaft axis of the engine, the second side wall is located on a second lateral side of the crankshaft axis, an engine rotational direction between the first and second side walls is from the first side wall toward the second side wall, the first side wall defines an inlet opening for receiving a downward air stream and introducing the air stream into a lower space between the bottom of the shallow section and the baffle plate, the inlet opening opens upwards between the first side wall and the baffle plate to receive the downward air stream, the adjacent barrier comprises a first side surface facing toward the first side wall, bounding a first side longitudinal channel and forming an inlet tapered section for leading the air from the first channel into the constricted gap, and a second side surface facing toward the second side wall, bounding a second side longitudinal channel, and forming an outlet tapered section for diffusing the air into the second side longitudinal channel, and the oil collecting slit opens into the outlet tapered section.

5. An oil pan structure according to claim 3 wherein the oil collecting slit is defined between first and second edges formed in the baffle plate, the second edge is raised above the first edge and the oil collecting slit opens toward the first side wall on an upper side of the baffle plate.

6. An oil pan structure according to claim 5 wherein the first edge of the oil collecting slit is located on the first lateral side of the second edge, and the constricted gap extends alongside the first edge of the oil collecting slit.

7. An oil pan structure according to claim 3 wherein the baffle plate is formed with a plurality of rows each of which comprises a plurality of the oil collecting slits extending alongside one of the flow regulating barriers.

8. An oil pan structure according to claim 3 wherein the baffle plate comprises a first depression (20) formed directly under one of connecting rods of the engine, and a second depression formed directly under another of the connecting rods and each of the depressions comprises a deepest region in which the oil collecting slit is opened.

9. An oil pan structure according to claim 3 wherein the baffle plate comprises first and second lateral side margins separated along a lateral direction perpendicular to the longitudinal direction, and the oil pan structure comprises an inlet opening (30) for catching a downward air stream along the first side wall caused by the crankshaft rotation, and introducing the air stream into a lower space between the baffle plate and the bottom of the shallow section of the oil pan.

10. An oil pan structure according to claim 3 wherein a first one of the flow regulating barriers is a middle barrier extending just below the crankshaft axis, a second one of the flow regulating barriers is a first side barrier extending between the middle barrier and the first side wall of the oil pan, and the baffle plate comprises a first row of the oil collecting slits extending alongside the first side barrier and a second row of the oil collecting slits extending alongside the middle barrier.

11. An oil pan structure for an internal combustion engine, comprising:

an oil pan comprising an oil receiving bottom and first and second side walls extending along an engine rotation axis and defining an oil collecting space under the engine rotation axis; and a baffle plate extending over the bottom of the oil pan, and separating a lower subspace formed between the bottom of the oil pan and the baffle plate in the oil collecting space, from an upper subspace over the baffle plate;

wherein the oil pan further comprises a flow regulating barrier projecting upward from the bottom of the oil pan, extending along the engine rotation axis and separating a first oil collecting channel (15, 16) located between the flow regulating barrier and the first side wall in the lower subspace, from a second oil collecting channels located between the flow regulating barrier and the second side wall in the lower subspace;

wherein the baffle plate comprises an oil collecting hole for introducing an engine lubricating oil from the upper subspace to the lower subspace;

wherein the first and side walls of the oil pan confront each other across an imaginary vertical middle plane passing through the engine rotation axis and diving the oil pan structure into left and right halves, the first side wall is located on a first lateral side of the middle plane, the second side wall of the oil pan is located on a second lateral side of the middle plane opposite to the first lateral side, the baffle plate extends from the second lateral side, through the middle plane to the first lateral side, and an air inlet opening for introducing a downward air stream produced by an engine rotation into the first channel in the lower subspace under the baffle plate is formed on the first lateral side between the first side wall and the baffle plate; and wherein the flow regulating barrier comprises an upper barrier end defining a venturi throat for constricting a lateral fluid stream from the first channel to the second channel in a first lateral direction from the first side wall toward the second side wall to create a pressure drop as a fluid flows through the venturi throat from the first channel to the second channel, the venturi throat is formed between the upper barrier end of the flow regulating barrier and the baffle plate, the oil collecting hole opens into the second channel near the upper barrier end to cause the oil to be sucked from the upper subspace into the second channel in the lower subspace by the pressure drop created by the fluid flow through the venturi throat.

12. An oil pan structure according to claim 11 wherein the first lateral side is one of left and right sides of the engine rotation axis on which an engine rotation is a downward angular motion, and the second lateral side is an opposite side on which the engine rotation is an upward angular motion.

13. An oil pan structure according to claim 11 wherein the oil collecting hole opens toward the first side wall in the upper subspace.

14. An oil pan structure according to claim 13 wherein the baffle plate extends from the second side wall across the middle plane to a first lateral side margin, the air inlet opening is defined between the first side wall of the oil pan and the first lateral side margin of the baffle plate, and the first side wall comprises an inside wall surface for guiding the downward air stream into the lower subspace under the baffle plate.

15. An oil pan structure according to claim 14 wherein the oil collecting hole is in a form of a slit cut in the baffle plate, the oil collecting hole is defined between first and second plate edges extending from a first slit end to a second slit end along the engine rotation axis, the second edge is located above the first edge of the oil collecting hole, the flow regulating barrier comprises a first side surface facing the first channel and a second side surface sloping in the second channel, and the first edge of the flow regulating hole is located just above the second side surface of the flow regulating barrier.

16. An oil pan structure according to claim 15 wherein the first side surface of the flow regulating barrier is steeper than the second side surface of the flow regulating barrier.

17. An oil pan structure according to claim 15 wherein the baffle plate is formed with a plurality of the oil collecting holes which are arranged in a row along the flow regulating barrier.

18. An oil pan structure according to claim 17 wherein the baffle plate comprises a second lateral side margin fixed to the second side wall of the oil pan, and concave middle depressions depressed between the first and second lateral side margins of the baffle plate, and each of the oil collecting holes opens in a deepest location in a unique one of the middle depressions; and wherein the flow regulating barrier is located just below the engine rotation axis, and the imaginary middle plane passes through the flow regulating barrier.

19. An oil pan structure according to claim 15 wherein the oil pan is formed with a plurality of the flow regulating barriers, one of the flow regulating barriers is a first lateral side barrier extending longitudinally between the first side wall and the middle plane, another of the flow regulating barriers is a middle barrier extending longitudinally between the second side wall and the first lateral side barrier, the baffle plate is formed with a first row of the oil collecting holes extending alongside the first lateral side barrier and a second row of the oil collecting holes extending alongside the middle barrier, and the venturi throat is formed for each of the oil collecting holes.

20. An oil pan structure according to claim 19 wherein the oil pan is formed with a second lateral side barrier forming a second lateral side channel between the second side wall and the second lateral side barrier, the baffle plate comprises an upright oil guide projecting upwards from the second lateral side margin and separating the upper space and a downward oil guide passage for guiding the engine lubricating oil into the second lateral side channel; wherein the baffle plate extends over the second lateral side barrier and closes off the second lateral side channel to prevent the oil from flowing between the second lateral side channel and the upper space; wherein the first lateral side barrier is taller than the middle barrier, and the first row of the oil collecting holes is located above the second row of the oil collecting holes; wherein each oil collecting hole of the first row is formed in a unique one of the depressions; wherein the engine rotation axis is an axis of a crankshaft of the engine; wherein the oil pan comprises a deep oil storage section for storing the oil, and each channel extends longitudinally along the engine rotation axis to guide the lubricating oil into the deep section; and wherein each barrier has an end segment curved toward the first side wall.

* * * * *